United States Patent [19]

Williams

[11] Patent Number: 5,005,509

[45] Date of Patent: Apr. 9, 1991

[54] DINGHY SPAR AND EQUIPMENT CARRIER

[76] Inventor: D. Scot Williams, 123 E. Churchwell, Knoxville, Tenn. 37917

[21] Appl. No.: 261,127

[22] Filed: Oct. 24, 1988

[51] Int. Cl.[5] ..... B63B 17/00

[52] U.S. Cl. ..... 114/343; 114/364; 114/90; 211/60.1; 224/309

[58] Field of Search ..... 211/60.1, 70.8; 224/42.07, 309, 324, 326, 328, 922; 114/39.1, 343, 364, 89, 90

[56] References Cited

U.S. PATENT DOCUMENTS

| | | | |
|---|---|---|---|
| 2,009,721 | 7/1935 | Williams | 224/309 |
| 3,082,878 | 3/1963 | Thomas | 211/60.1 |
| 3,674,170 | 7/1972 | Thorpe et al. . | |
| 3,696,979 | 10/1972 | Erickson | 224/309 |
| 4,170,801 | 10/1979 | Ward . | |
| 4,311,262 | 1/1982 | Morin | 211/70.8 |
| 4,352,337 | 10/1982 | Wyoral . | |
| 4,417,539 | 11/1983 | Thompson . | |
| 4,527,827 | 7/1985 | Maniscalco et al. | 224/324 |
| 4,528,925 | 7/1985 | Pyburn . | |
| 4,569,301 | 2/1986 | Pyburn . | |
| 4,593,642 | 6/1986 | Shay . | |
| 4,662,303 | 5/1987 | Duff . | |
| 4,724,791 | 2/1988 | McSorley . | |
| 4,777,900 | 10/1988 | Abeene et al. | 114/343 |

FOREIGN PATENT DOCUMENTS

| | | | |
|---|---|---|---|
| 2024368 | 2/1972 | Fed. Rep. of Germany | 224/328 |
| 8501023 | 3/1985 | World Int. Prop. O. | 224/309 |

*Primary Examiner*—Sherman Basinger
*Assistant Examiner*—Stephen P. Avila
*Attorney, Agent, or Firm*—Pitts and Brittian

[57] ABSTRACT

A dinghy spar and equipment carrier (10) which is provided with an enclosure (12) for carrying various paraphernalia related to the operation of a dinghy. Yokes (26) are mounted proximate the upper portion of the enclosure (12) and receive spars/oars therein. The yokes (26) are designed for carrying spars/oars of various shapes, sizes, etc., without marring their surfaces. Suitable feet (48) are provided for supporting the enclosure on the boat in a manner which will preserve the integrity of the deck surface. The carrier is secured to a dinghy by a suitable strap (52) which is wrapped about the hull in the preferred embodiment.

7 Claims, 2 Drawing Sheets

DINGHY SPAR AND EQUIPMENT CARRIER

TECHNICAL FIELD

This invention relates generally to a device for carrying equipment associated with the operation of dinghies, and more particularly concerns a carrier for spars and/or equipment needed in the operation of a dinghy.

BACKGROUND ART

A dinghy is a small boat propelled by oars, sails or the like, and may be used for sport or carried on a larger boat as a tender or a life boat. Operation of dinghies generally requires related equipment such as spars, centerboard, rudder, tiller, sail, riggings, together with life vests and suitable apparel. During transport and stowage, it is desirable for the spars, oars, and/or related equipment to be organized and secured This is particularly important during transport to prevent spars, oars or the like from falling from the boat. Heretofore, devices have been known which are designed to secure spars to the dinghy during transit or for storing certain equipment or food items during boat operation. For example, U.S. Pat. No. 4,352,337 issued to Wyoral discloses a device for carrying the mast and boom on a small boat or dinghy. Various other form of equipment carriage devices are disclosed in the following U.S. Pat. Nos.: 3,674,170 issued to Thorpe, et al.; U.S. Pat. No. 4,170,801 issued to Ward; U.S. Pat. No. 4,417,539 issued to Thompson; U.S. Pat. No. 4,528,925 issued to Pyburn; U.S. Pat. No. 4,569,301 issued to Pyburn; U.S. Pat. No. 4,593,642 issued to Shay; U.S. Pat. No. 4,662,303 issued to Duff; and U.S. Pat. No. 4,724,791 issued to McSorley.

While known prior devices have been directed to assist in organizing small boat and dinghy equipment, certain problems related to the transport and stowage of such equipment, and particularly spars, still remain.

Accordingly, it is an object of the present invention to provide a dinghy spar and/or equipment carrier for the safe and secure transport and stowage of spars and/or paraphernalia necessary for the operation of a dinghy.

It is another object of the present invention to provide such a carrier which fits various sized dinghies without modification and which is capable of securing spars and/or oars of varying quantities, shapes and sizes without fear of marring their finish. Moreover, the container of the present invention is provided with yokes which enable the safe and secure transit and/or storage of spar without chafing their surfaces.

DISCLOSURE OF THE INVENTION

Other objects and advantages will be obvious, and will in part appear hereinafter and will be accomplished by the present invention which provides a dinghy spar and/or equipment carrier for transporting and storing spar and other equipment used in the operation of a dinghy. The carrier of the present invention includes and enclosure which is provided proximate its lower surface with support members such as feet, runners or the like which engage the surface of the dinghy during storage and/or transport. The enclosure is provided with a compartment for receiving paraphernalia relating to the operation of the dinghy, such as centerboard, rudder, tiller, sail, riggings, together with life vests and other suitable apparel. Yokes are mounted on the carrier for releasably engaging the spars or oars of the dinghy.

In one embodiment, the yokes are used without the enclosure. The yokes are fabricated such that the surface of the oars or spars are not marred during transport.

BRIEF DESCRIPTION OF THE DRAWINGS

The above-mentioned features of the present invention will be more clearly understood from consideration of the following description in connection with the accompanying drawings in which.

BEST MODE FOR CARRYING OUT THE INVENTION

Figure 1:
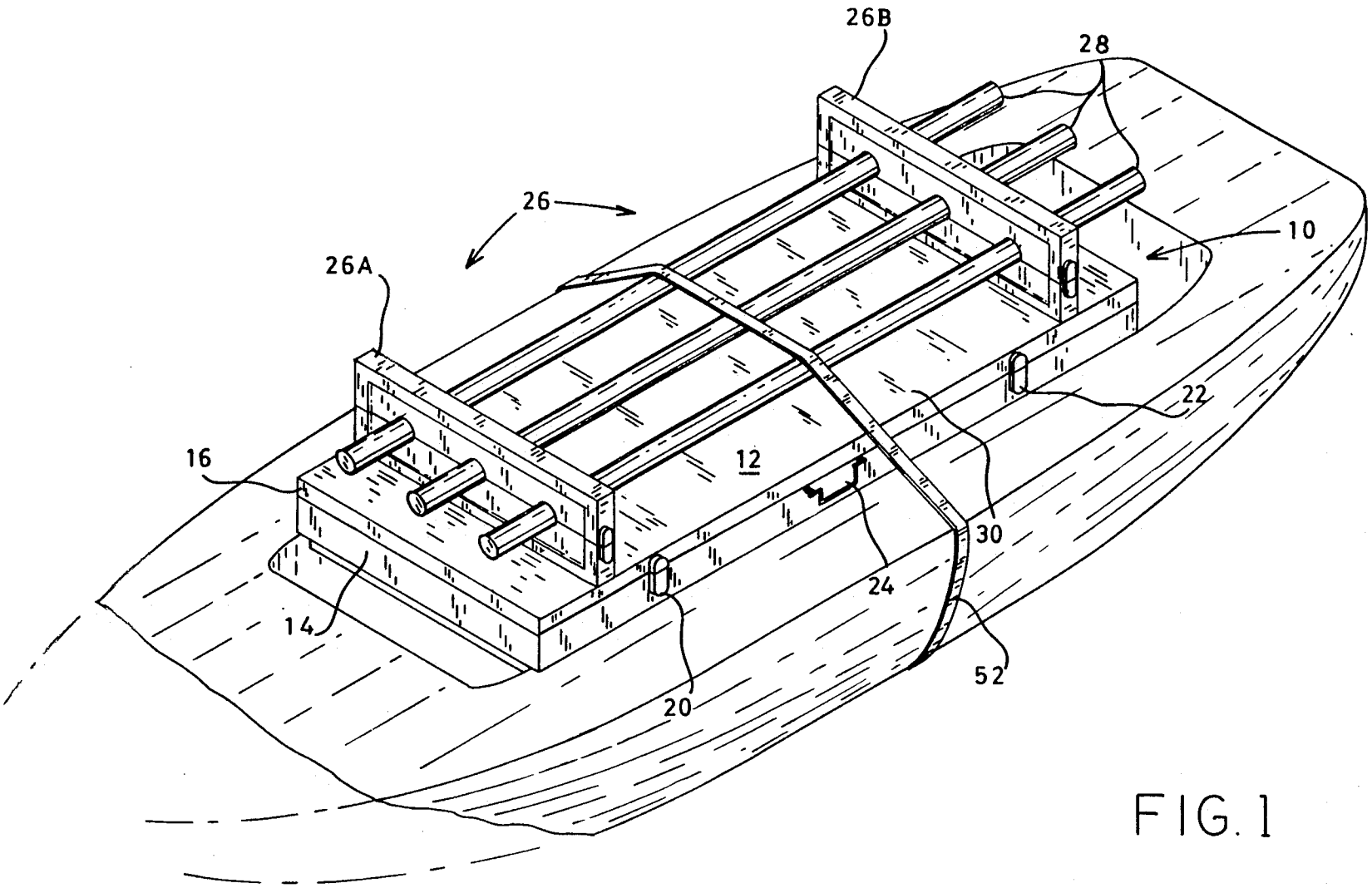
FIG. 1 is a prespective view of a carrier for a dinghy constructed in accordance with various features of the present invention.

Referring now the figures, a dinghy spar and equipment carrier constructed in accordance with various features of the present invention is shown generally at 10 in FIG. 1. The carrier 10 is designed for being used in connection with a small boat, and more specifically a dinghy propelled by oars or sails. In this connection, the carrier 10 includes an enclosure generally indicated at 12 in the preferred embodiment. The enclosure in the illustrated embodiment is substantially rectangular in configuration and defines a compartment which is dimensioned for receiving all paraphernalia, other than the spars or oars, relating to the operation of a dinghy such as the centerboard, rudder, tiller, sail, riggings, together with life vests and other suitable apparel. This enclosure 12, in the preferred embodiment, comprises a stowage box having a lower portion 14 which is selectively opened and closed by the lid portion 16. In this regard, suitable hinges generally indicated at 18 (see FIG. 2) are provided such that the lid portion 16 is pivotally mounted on the lower portion 14. The forward portion of the enclosure or box 12 is provided with suitable hasps 20 and 22, or other conventional devices for selectively securing the lid portion 16 to the lower portion 14 for storage and transport. A suitable suitcase type handle 24 is provided on the forward portion of the enclosure 12 to facilitate carrying the container 10. As necessary or desired, a shoulder strap can be provided for manually carrying the carrier.

Figure 2:
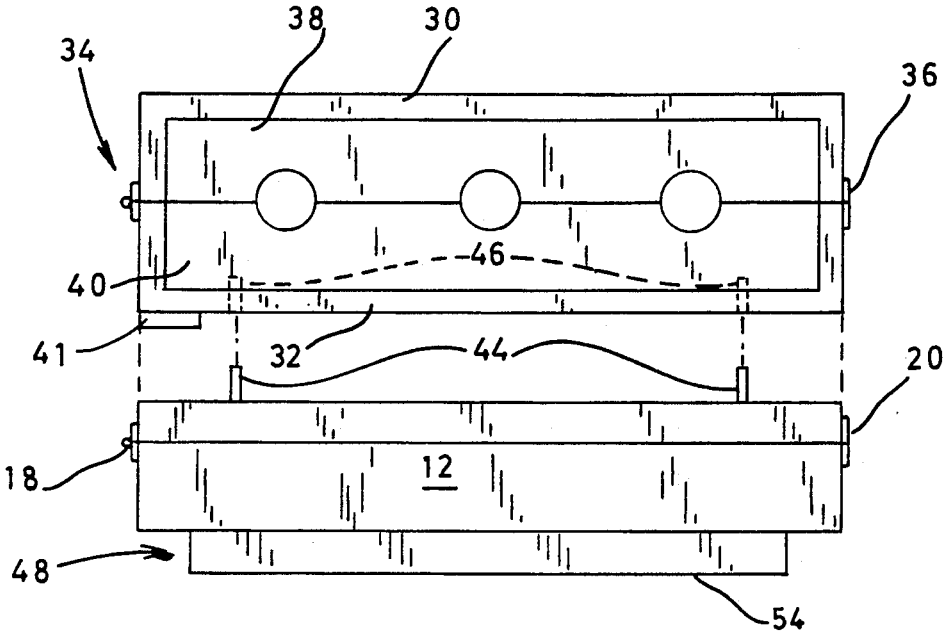
FIG. 2 is a partially exploded end view of the carrier shown in FIG. 1 with the spars removed and the yokes closed. The yokes can be used without the enclosure in one embodiment.

Yokes generally indicated at 26 are provided for receiving the spars 28 during transport and storage. The yokes of the illustrated embodiment comprise a spaced apart pair of individual yokes 26A and 26B which are mounted proximate the forward end portion and rearward end portion of the upper surface 30 of the enclosure 12 as shown in FIG. 1. Each of the yokes of the preferred embodiment include upper and lower frame members 30 and 32, respectively, as shown in FIG. 2. These frame members are U-shaped in the illustrated embodiment, and are hinged together proximate the location 34 as shown in FIG. 2. Closure of the frame members is secured by suitable hasps or other releasably connecting devices of conventional design which are mounted proximate location 36.

In accordance with one feature of the present invention, it is desirable to provide means for securing spars or oars of varying quantities, shapes and sizes without marring their finish. To this end, compressible members 38 and 40 are carried by the upper and lower frame members 30 and 32, respectively. These compressible members are preferably fabricated from a closed cell foam or other suitable compressible material such as soft rubber or the like, and are partially received within and secured to the upper and lower frame members 30 and 32 as shown in FIGS. 1 and 2. When the spars are laid onto the upper surface of the lower compressible members 40 at spaced locations, and the upper frame member is closed and secured as is shown in FIG. 1, the spars are held at spaced apart locations from each other and from the frame members by the compressible members thereby preventing marring of their surfaces. Moreover, since the members 38 and 40 compress continuously along their length in the preferred embodiment, varying numbers of spars can be carried by the yokes. Thus, the need for fabricating individual cradles for each spar or oar carried by the carrier 10 is eliminated.

The yokes 26 are detachable from the enclosure, and in the preferred embodiment are shaped such that they can be used with or without the enclosure. More specifically, FIG. 2 shows the feature of removing the yokes from enclosure 12. When it is desired to use the yokes without the enclosure 12, a suitable non-skid member 41 can be added to the lower surface of the yoke frame. This member 41 will extend, in the preferred embodiment, along the length of the lower frame member and keep the yokes from skidding on or scarring the deck or cockpit opening of the dinghy. When the yokes are used without the enclosure 12, they are preferably mounted within the cockpit opening or on the deck. The spars or oars serve to keep the yokes spaced apart and as longitudinal frame members.

Mounting of the yokes 26 onto the enclosure 12 is accomplished by pairs of alignment pins generally indicated at 44 in FIG. 2. These alignment pins serve as means for releasably securing the yokes to the upper surface of the enclosure. In this regard, it will be noted that the alignment pins 44 are received within registering openings 46 provided at the locations indicated in FIG. 2.

Figure 3:
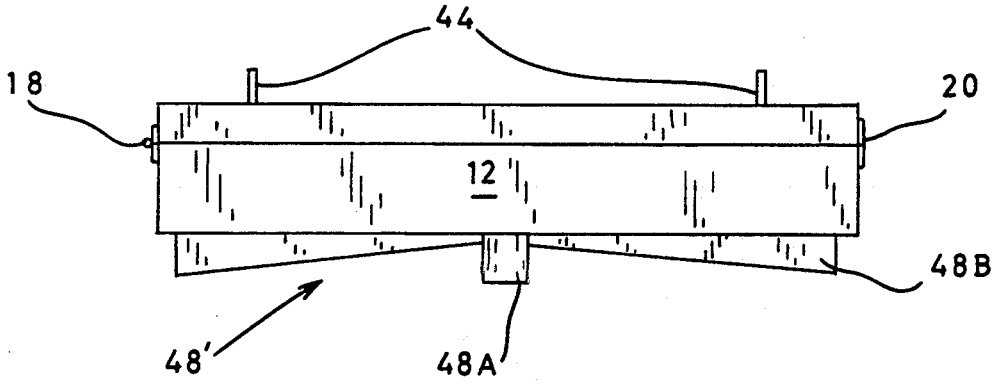
FIG. 3 is a front view of an enclosure with the yokes detached showing an alternate embodiment of support members or feet which engage the contour of a dinghy deck when mounted thereon.

Means are also provided for supporting the enclosure 12 on the dinghy. To this end, suitable support members or feet generally indicated at 48 are mounted proximate the forward and rearward end portions at spaced locations on the lower surface of the enclosure 12 as shown in FIG. 1. These feet are designed to fit within the cockpit in a snug manner in the preferred embodiment as shown in FIG. 2. Alternate means for supporting the enclosure 12 on the deck of the dinghy are shown in FIG. 3 at 48'. The means 48' includes a runner 48B designed for fitting into or onto the contour of the boat deck, and includes a suitable peg 48A which is dimensioned for being received within the mast step of a conventional dinghy. Thus, in the alternate embodiment 48' shown in FIG. 3, foot or runner 48B fits within the cockpit, and foot or peg 48A is received within the mast step to help secure the carrier 12 to the boat deck for transport.

From the foregoing detailed description, it will be recognized that a dinghy spar and equipment carrier having certain improvements over the known prior art has been provided. More specifically, the carrier 10 of the present invention is designed for providing a safe and secure method of containment for the equipment and spars needed in the operation of a dinghy. Moreover, the device can be secured to the boat by a suitable strap 52 as shown in FIG. 1 which holds the carrier onto the boat. Release of the strap enables the sailor to move the carrier to a desired location, and a suitable handle is provided to facilitate this operation. The carrier is preferably provided proximate the lower surfaces of the means 48 for supporting the enclosure 12 on the boat with a non-skid surface at 54 which assists in preventing structural and cosmetic damage to the boat deck during transit. The carrier support members are designed to fit various shaped dinghies without modification.

Thus, although there has been described to this point particular embodiments of the present invention of a dinghy spar and equipment carrier, it is not intended that specific references be considered limitations upon the scope of this invention except insofar as set forth in the following claims and equivalents thereof.

I claim:

1. A dinghy spar and equipment carrier for removable mounting on a dinghy/boat, said dinghy/boat defining a cockpit, said carrier comprising:

an enclosure for receiving equipment related to the operation of a dinghy/boat, said enclosure having a top portion and a bottom portion, said bottom portion defining a bottom surface, said enclosure also having first and second opposite end portions;

a pair of selectively spaced yoke members mounted on said enclosure for cooperatively engaging and carrying oars/spars; and support means for mounting said enclosure on said dinghy/boat, said support means including at least on support member mounted on said bottom surface of said enclosure for being received in said cockpit so as to restrict lateral movement of said enclosure as it is mounted on said dinghy/boat, said support member being positioned upon said bottom surface such that at least a portion of said bottom surface supportively engages said dinghy/boat proximate the perimeter of said cockpit.

2. The dinghy spar and equipment carrier of claim 1 wherein said support means comprises a first said support member positioned proximate said first end portion of said enclosure and a second said support member disposed proximate said second end portion of said enclosure.

3. A dinghy spar and equipment carrier for removable mounting on a dinghy/boat, said dinghy/boat being provided with a mast step, said carrier comprising:

an enclosure for receiving equipment related to the operation of a dinghy/boat, said enclosure having a top portion and a bottom portion, said bottom portion defining a bottom surface, said enclosure also having first and second opposite end portions;

a pair of selectively spaced yoke members mounted on said enclosure for cooperatively engaging and carrying oars/spars; and support means for mounting said enclosure on said dinghy/boat, said support means including a peg disposed on said bottom surface of said enclosure for being closely received in said mast step to restrict movement of said carrier as it is mounted on said dinghy/boat.

4. The dinghy spar and equipment carrier of claim 3 wherein said dinghy/boat is provided with a deck, and wherein said support means further includes at least one support member mounted on said bottom surface of said enclosure for engaging said deck and supporting said enclosure thereon.

5. The dinghy spar and equipment carrier of claim 4 wherein said support member comprises a runner defining a deck engaging surface contoured to closely engage said deck.

6. A dinghy spar and equipment carrier for removable mounting on a dinghy/small boat, said dinghy/small boat being provided with a cockpit, said carrier comprising:

an enclosure for receiving equipment related to the operation of a dinghy/small boat, said enclosure having a top portion defining an upper surface and a bottom portion defining a bottom surface, said top portion serving as a closure for selectively accessing said enclosure, said enclosure further defining first and second end portions;

a pair of selectively spaced yoke members releasably mounted on said upper surface of said enclosure for cooperatively engaging and supporting oars/spars therebetween, one said yoke member being disposed proximate said first end portion of said enclosure and the other said yoke member being disposed proximate said second end portion of said enclosure; and support means for mounting said enclosure on said dinghy/boat, said support means including at least a first and second support member mounted on said bottom surface proximate said first and second end portions, respectively, of said enclosure, each said support member extending laterally across said bottom surface and having oppositely disposed outboard ends terminating at a location spaced from the perimeter of said lower surface, whereby said outboard ends of said support members are closely received in said cockpit to restrict lateral movement of said and whereby said bottom surface extends beyond said cockpit to engage said dinghy/boat and support said carrier thereon.

7. A dinghy spar and equipment carrier for removable mounting on a dinghy/small boat, said dinghy/small boat being provided with a mast step and a deck, said carrier comprising:

an enclosure for receiving equipment related to the operation of a dinghy/small boat, said enclosure having a top portion defining an upper surface and a bottom portion defining a bottom surface, said top portion serving as a closure for selectively accessing said enclosure, said enclosure further defining first and second end portions;

a pair of selectively spaced yoke members releasably mounted on a said upper surface of said enclosure for cooperatively engaging and supporting oars/spars therebetween, one said yoke member being disposed proximate said first end portion of said enclosure and the other said yoke member being disposed proximate said second end portion of said enclosure; and support means for mounting said enclosure on said dinghy/small boat, said support means including a peg disposed on said bottom surface of said enclosure for being closely received in said mast step to restrict movement of said carrier as it is mounted on said dinghy/small boat, and also including at least one runner mounted on said bottom surface, said runner having a deck engaging surface contoured to closely engage said deck.

* * * * *